US006295034B1

(12) United States Patent
Brown et al.

(10) Patent No.: US 6,295,034 B1
(45) Date of Patent: Sep. 25, 2001

(54) COMMON APERTURE REFLECTOR ANTENNA WITH IMPROVED FEED DESIGN

(75) Inventors: Kenneth W. Brown; Thomas A. Drake, both of Yucaipa, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/514,061

(22) Filed: Feb. 25, 2000

(51) Int. Cl.[7] ..... H01Q 19/14

(52) U.S. Cl. ..... 343/781 CA; 343/781 R; 343/781 P; 343/835; 343/837

(58) Field of Search ..... 343/700 MS, 725, 343/781 R, 781 P, 781 CA, 835, 837, 893, 909; H01Q 19/14

(56) References Cited

U.S. PATENT DOCUMENTS

| | | | | |
|---|---|---|---|---|
| 4,482,897 | | 11/1984 | Dragone et al. | 343/779 |
| 4,636,797 | * | 1/1987 | Saffold et al. | 343/725 |
| 4,689,632 | | 8/1987 | Graham | 343/781 P |
| 4,866,454 | * | 9/1989 | Droessler | 343/725 |
| 5,041,840 | * | 8/1991 | Cipolla et al. | 343/725 |
| 5,214,438 | | 5/1993 | Brusgard et al. | 343/725 |
| 5,298,909 | * | 3/1994 | Peters et al. | 343/720 |
| 5,327,149 | * | 7/1994 | Kuffer | 343/720 |

* cited by examiner

*Primary Examiner*—Don Wong
*Assistant Examiner*—Shih-Chao Chen
(74) *Attorney, Agent, or Firm*—Renner, Otto, Boisselle & Sklar, LLP

(57) ABSTRACT

A common aperture reflector antenna and feed are provided for use in common aperture sensor systems. The feed includes an array of individual elements. The array elements are configured to increase the overall efficiency of a reflector antenna by flattening the aperture illumination, and also by nullifying the illumination within the centrally-blocked-portion of the reflector antenna surface. More specifically, the array elements are carefully configured with respect to spacing and excitation, for example, such that the array illuminates only the non-blocked portion of the main reflector. In addition, the array pattern is optimized such that the non-blocked portion of the reflector antenna is quasi-uniformly illuminated.

20 Claims, 5 Drawing Sheets

COMMON APERTURE REFLECTOR ANTENNA WITH IMPROVED FEED DESIGN

TECHNICAL FIELD

The present invention relates generally to an antenna, and more particularly to a common-aperture antenna with a high-efficiency feed and a method for designing the same.

BACKGROUND OF THE INVENTION

Common aperture antennas are generally known. For example, U.S. Pat. No. 5,214,438 describes a millimeter wave and infrared sensor in a common receiving aperture. In the past, false target acquisitions have degraded the cost effectiveness of single sensor seekers. Weather conditions and the time of day can adversely affect the ability of the sensor to acquire the target. Millimeter wave (MMW) energy is useful under adverse weather conditions. However, the resolution is not as precise as exhibited by optical systems operating in the infrared (IR) region. In an optical system, resolution is adversely affected by rain, fog or humidity. These conditions can reduce the effectiveness of such sensors in the optical spectral region. Target acquisition can be substantially improved by combining millimeter wave and infrared optical signals, substantially reducing the influence of climatic conditions. IR and MMW are also susceptible to known countermeasures of various kinds and therefore a combined aperture system is less susceptible to a single type of countermeasure.

Despite the aforementioned advantages associated with such common aperture antennas, applicants have found that various problems exist with conventional designs. For example, a prime-focus reflector antenna design may have an abnormally large amount of central blockage (much larger than the feed would normally induce) created by another part of the overall system. In such a situation, it is left to the antenna designer to maximize the reflector antenna performance in the presence of this blockage.

As a more specific example, an IR sensor within the common aperture antenna may share the same main reflector surface as an RF (microwave or millimeter wave) reflector antenna. In such a situation, the reflector configuration is often dictated by the more stringent IR system requirements. This typically has an adverse affect on the performance of the RF system. That is to say what is advantageous for the IR system is typically not what is advantageous for the RF system.

In view of the aforementioned shortcomings associated with conventional designs, there is a strong need in the art for a common aperture antenna which can provide efficient operation with respect to each of the systems. For example, there is a strong need for a common aperture reflector antenna which may be optimized for an IR system and also efficiently configured for an RF system. Moreover, there is a strong need in the art for a method of designing such an antenna.

SUMMARY OF THE INVENTION

A common aperture reflector antenna and feed are presented for use in common aperture sensor systems. In an exemplary embodiment of the invention, the feed includes an array of individual elements. The array elements are configured to increase the overall efficiency of a reflector antenna by flattening the aperture illumination, and also by nullifying the illumination within the centrally-blocked-portion of the reflector antenna surface. More specifically, the array elements are carefully configured with respect to spacing and excitation, for example, such that the array illuminates only the non-blocked portion of the main reflector. In addition, the array pattern is optimized such that the non-blocked portion of the reflector antenna is quasi-uniformly illuminated.

According to one aspect of the invention, a common aperture reflector antenna is provided. The antenna includes a main reflector having a generally parabolic reflective surface and a boresight axis extending from a vertex of the main reflector through a focal point of the main reflector. In addition, the antenna includes a feed located generally at the focal point for illuminating the main reflector with and/or receiving from the main reflector radio frequency (RF) energy of a predefined RF wavelength to transmit/receive RF energy; and at least one of a sub-reflector and a sensor located generally at the focal point for reflecting or receiving energy of a predefined wavelength different from the predefined RF wavelength. A blockage of the main reflector due to the sub-reflector or the sensor along the boresight axis is equal or greater than a blockage of the main reflector due to the feed. In order to counteract such blockage, the feed is configured to direct a majority of RF energy from the feed towards regions of the main reflector which are not blocked by the sub-reflector or the sensor.

According to another aspect of the invention, a method is provided for designing such an antenna. The method includes the steps of selecting an initial estimate for a feed array making up the feed on a basis of blockage of the main reflector due to the sub-reflector or the sensor and at least one of a number of array elements, spacing of the array elements, amplitude excitation of the array elements, diameter of the main reflector and focal length of the main reflector; evaluating a performance of the feed array based on the initial estimate; computing a figure of merit indicative of the RF efficiency of the antenna based on the evaluated performance; and optimizing the RF efficiency by altering the initial estimate and reevaluating the performance and figure of merit.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENT

Figure 1:
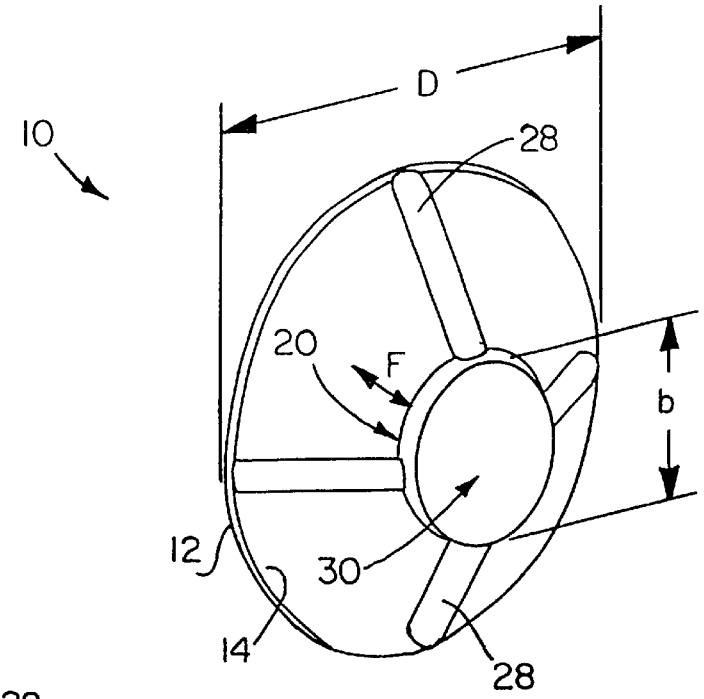
FIG. 1 is a perspective view of a common aperture reflector antenna in accordance with the exemplary embodiment of the present invention.

The present invention will now be described with reference to the drawings, wherein like reference numerals are used to refer to like elements throughout.

Figure 2:
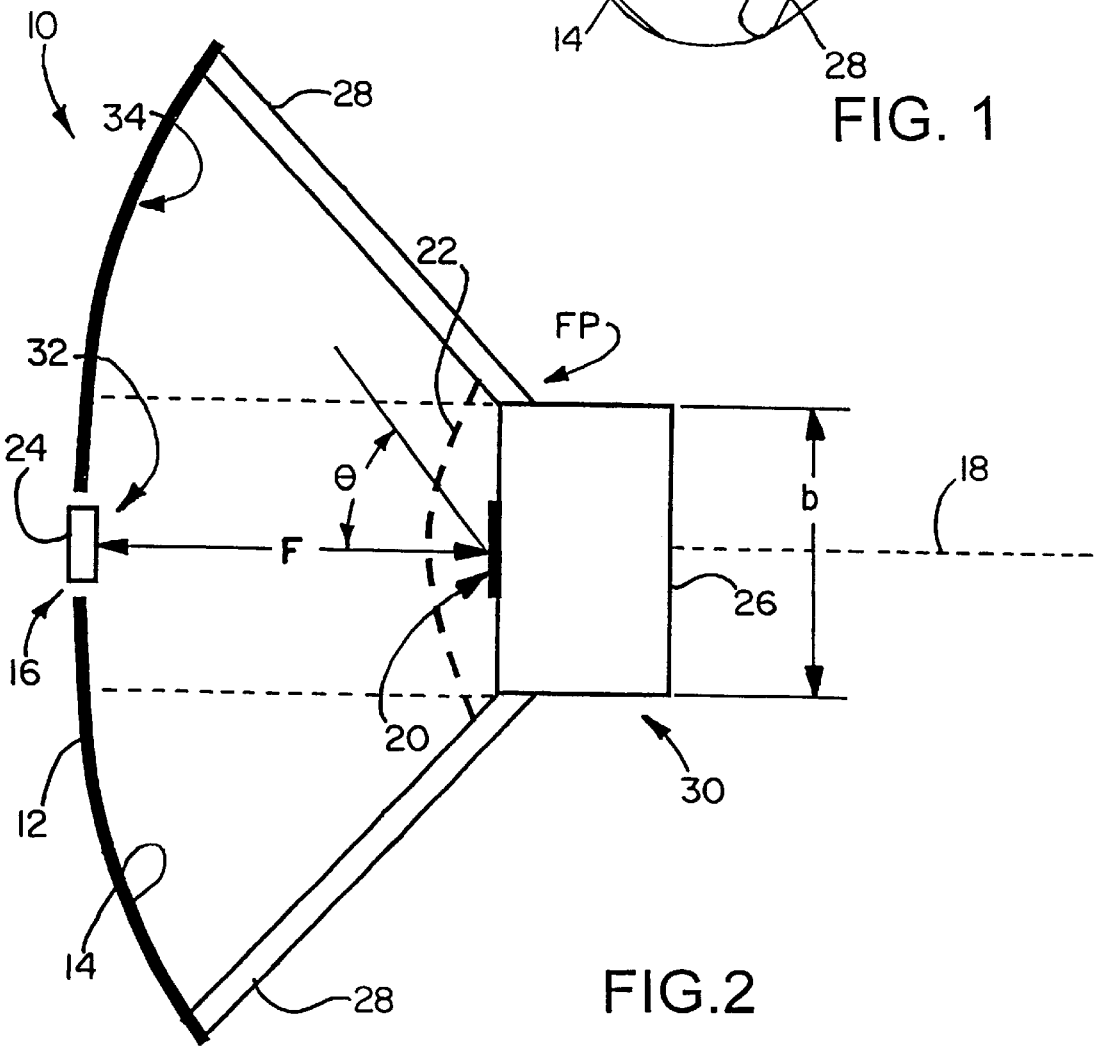
FIG. 2 is a diagrammatic side view of the antenna of FIG. 1.

Referring initially to FIGS. 1 and 2, a common aperture reflector antenna 10 is shown in accordance with the present invention. The antenna 10 includes a main reflector 12 having a surface 14 which is reflective to both microwave/millimeterwave RF energy and infrared (IR) energy. In the exemplary embodiment, the main reflector 12 has a circular aperture with a diameter D as shown in FIG. 1. The main reflector is parabolic or quasi-parabolic in cross-section, with a focal point FP located at a focal length F from a vertex 16 of the main reflector 12. As is shown in FIG. 2, a boresight axis 18 of the antenna 1 0 extends from the vertex 16 of the main reflector 12 through the focal point FP and is thus directed towards a target of interest during use.

The antenna 10 further includes an RF feed 20 located generally at the focal point FP of the main reflector 12. The RF feed 20 is positioned such that in the case of transmitting an RF signal, the RF feed 20 illuminates the main reflector 12 with RF energy in order that the RF energy is reflected by the main reflector 12 along the boresight axis 18 towards the target (not shown). In the case of receiving an RF signal, the RF feed is positioned so as to receive the RF energy reflected theretowards by the main reflector 12.

According to one embodiment of the present invention, an IR sub-reflector 22 is located approximately at the focal point FP in between the main reflector 12 and the RF feed 20. As is described in U.S. Pat. No. 5,214,438, for example, such an IR sub-reflector 22 may be made of a dichroic element which reflects IR energy yet transmits RF energy. The IR sub-reflector 22 reflects IR energy received from the main reflector 12 to an IR sensor 24 located generally at the vertex 16 of the main reflector 12. At the same time, the IR sub-reflector 22 allows RF energy to pass therethrough between the RF feed 20 and the main reflector 12. A third sensor 26, such as a laser radar system, is mounted in front of the RF feed 20 as shown is in FIG. 2. The third sensor 26 may, from necessity, have a relatively large diameter compared to the RF feed 20 and the IR sub-reflector 22. One or more struts 28 serve to support the IR sub-reflector 22, the RF feed 20 and/or the third sensor 26.

According to another embodiment, the antenna 10 may include only one of the IR sub-reflector 22/IR sensor 24 and the third sensor 26 without departing from the scope of the invention. In either case, the RF feed 20, IR sub-reflector 24 and/or the third sensor 26 present an overall blockage 30 with respect to RF energy having a maximum diameter b relative to the main reflector 12. As is shown in FIG. 2, the blockage 30 serves to create a blocked region 32 on the surface of the main reflector 12. Such blocked region 32 is shown as being projected by the maximum diameter b of the blockage 30 onto the main reflector 12 along the boresight axis 18. The struts 28 also serve to impose blockage on the main reflector 12, as will be appreciated. Non-blocked regions 34 of the main reflector 12 surround the blocked region 32.

It will be appreciated that the antenna 10 described above with respect to FIGS. 1 and 2 ordinarily will not be optimal from an RF standpoint. In fact several aspects of the design (imposed by the IR sensor/IR sub-reflector 22 and/or the third sensor 26) can substantially degrade the RF system performance. First, the paraboloidal shape of the main reflector 12 may not necessarily be optimal for the most efficient RF performance. Specially shaped main reflectors for use in Cassegrain systems can be used to substantially increase the RF antenna gain. However, the fact that the IR system uses a sub-reflector more than likely prevents the use of a Cassegrain RF system. Second, the use of an IR sub-reflector 22 between the RF feed 20 and main reflector 12 can induce a phase error on the RF wave. This phase error has the potential of degrading the RF antenna performance. Third, the location of the IR sensor 24 and the relatively large diameter third sensor 26 imposes an unusually large amount of central blockage 30 for the RF system. The energy from the RF feed 20 impinging on the central region of the main reflector 12 is essentially wasted because it is blocked and/or scattered by the IR sensor 24/sub-reflector 22 and/or third sensor 26. This blockage will ordinarily degrade the RF gain and increase the sidelobe levels. Such problems are complicated even further if the RF system is required to be monopulse as in the exemplary embodiment. For this a total of four sets of feeds are required for the RF system.

In order to give an idea of the extent of the blockage caused by the IR sensor 24/sub-reflector 22 and/or third sensor 26, an exemplary case may have a main reflector 12 with a diameter D (FIG. 1) equal to $8\lambda$, where $\lambda$ is the wavelength of the desired RF operating frequency. The focal length F (FIG. 2) is on the order of $3\lambda$ and the diameter of blockage b (FIG. 2) is on the order of $3\lambda$. Consequently, a large portion 32 of the center of the main reflector 12 is blocked (e.g., a diameter on the order of 30% to 40% of the diameter D of the main reflector 12).

Figure 3:
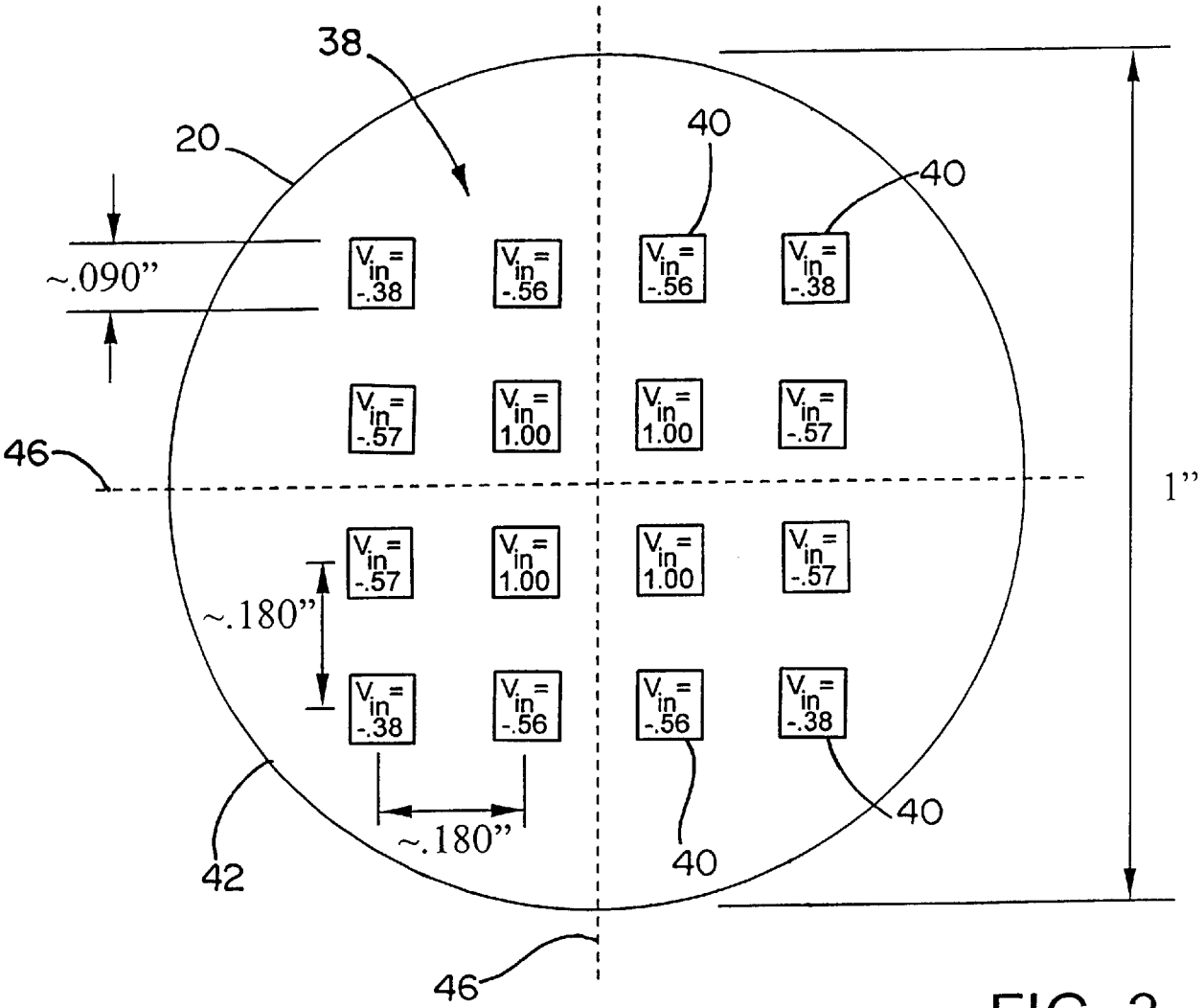
FIG. 3 is a front view of an exemplary feed array in accordance with the present invention.

The present invention overcomes many of such limitations by virtue of a specially configured RF feed 20. In the exemplary embodiment, the RF feed 20 is made up of an array of feed elements. For example, FIG. 3 illustrates a monopulse RF feed 20 having an array 38 of feed elements 40. By carefully configuring the array elements 40, some and/or all of the above limitations can be alleviated.

First, the array 38 in accordance with the present invention is configured to illuminate substantially only the non-blocked portion or portions 34 of the main reflector 12 (See FIG. 2). In doing so, RF energy is not wasted on the blocked portion 32 of the main reflector 12. As is explained more fully below, this is done by creating an RF feed 20 with a feed pattern that has a "hole" in its middle.

Second, the array 38 preferably is configured to flatten the RF energy illumination on the main reflector 12. In reflector antenna design there is typically a tradeoff between illumination efficiency and spillover loss. A flatter illumination may require spilling over more energy over the rim of the main reflector. For a standard reflector antenna feed (such as a horn) maximum gain or efficiency is obtained with an approximate −11 dB main reflector rim illumination (relative to the illumination of the center of the main reflector). This results in poor aperture efficiency and a spillover of approximately 10% of the feed energy. This scenario can be improved with the use of a Cassegrain system employing a sub-reflector. The sub and main reflector shapes can be tuned such that the illumination taper is essentially 0 dB with very little spillover. Since a Cassegrain is not possible for the above common aperture system, this efficient way of feeding the main reflector is not possible. However, by using an array 38 as the feed 20 in accordance with the present invention, the main reflector 12 illumination can be flattened, thereby optimizing the aperture efficiency. The array feed 20 radiation can also be made to drop-off rapidly at the rim of the main reflector 12, reducing the spillover loss. Third, the phasing between the array elements 40 can be modified to correct for any phase errors induced by the semi-transparent IR sub-reflector 22.

EXAMPLE

The inventors in the present application constructed and tested an antenna 10 in accordance with the principles of the invention. The antenna 10 was designed for operation at a millimeterwave frequency of 35 Gigahertz (GHz). A parabolic main reflector 12 having a diameter D=2.7" ("denotes inches) and a focal length F=1.09" was selected. These parameters were imposed by the IR sensor requirements. The imposed central blockage of the third sensor 26 presented a maximum blockage 30 with a diameter of b=1". Therefore, the size of the RF feed 20 was limited to this 1" diameter. At the desired millimeter wave frequency of 35 GHz, with the above imposed dimensions, a microstrip patch antenna array 38 was determined to be optimal for the feed 20 as represented in FIG. 3. The patch antenna array 38 was formed on a substrate 42 made of RT Duroid™ 6002 using conventional fabrication methods. The use of RT Duroid™ 6002 as the substrate 42 for the patch array 38 (which has a dielectric constant of 2.94) required square patch elements 40 that were approximately 0.090" on edge, which allowed a 4×4 array of patch elements 40 to be used (16 total) within the 1" diameter feed region.

The excitation and spacing of each patch element 40 in the 16 element array 38 was optimized for maximum reflector antenna efficiency using physical optics as is discussed in more detail below. The resultant optimized array spacing and desired input voltages for each patch are shown in FIG. 3 and represented by the following 4×4 matrix with the corresponding amplitude and phase of each element 40:

| | | | |
|---|---|---|---|
| −.38 | −.56 | −.56 | −.38 |
| −.57 | 1.00 | 1.00 | −.57 |
| −.57 | 1.00 | 1.00 | −.57 |
| −.38 | −.56 | −.56 | −.38 |

Note that the outer 12 patch elements 40 around the periphery of the array 38 are to be fed 180 degrees out-of-phase relative to the central four patch elements 40. Also, the respective quadrants formed by lines 46 in FIG. 3 delineate the corresponding groups which are commonly fed for monopulse operation. By adjusting the amount of power split between the patch elements 40 and line length difference in microstrip lines feeding the patch elements 40, the aperture array distribution as defined in FIG. 3 was obtained. A stripline arithmetic circuit layer was used to generate the sum and difference patterns for monopulse tracking. The details for forming a patch array and providing the appropriate amplitude and phase differences are well known in the art, and hence will not be discussed herein for sake of brevity.

Figure 4A:
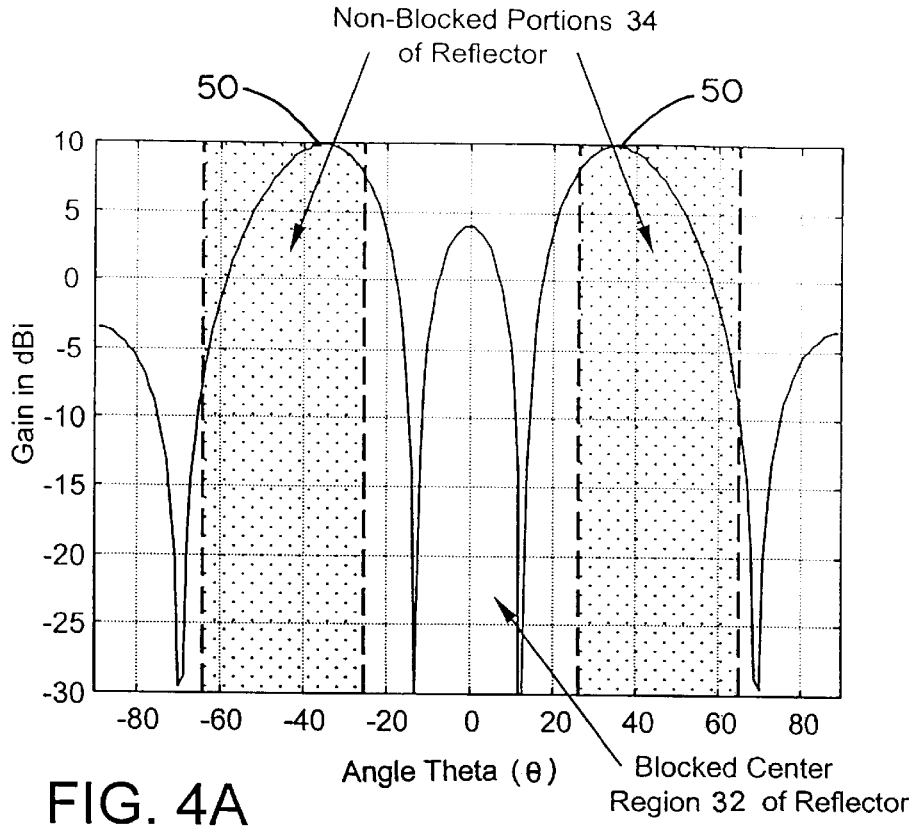
FIG. 4A is an estimated E-plane pattern for the feed array of FIG. 3.

The predicted sum channel pattern of this optimized array 38 is shown in FIG. 4A for the E-plane. Note that the pattern of the array 38 is optimized such that the majority of the feed energy from the RF feed 20 is directed toward the non-blocked regions 34 of the main reflector 12. In fact, each of the non-blocked regions 34 exhibit peaks 50 which exceed any peak or peaks in the blocked region 32. The central region 32 of the main reflector 12, which is blocked by the diameter b, is severely attenuated. In fact, very little RF feed energy is spilled-over the outer rim of the main reflector 12 or is wasted in the central blocked region 32. Also, it is noted that the illumination function in the non-blocked regions 34 of the parabolic reflector 12 is quasi-uniform (at an angle of about 40 degrees). It will be apparent to those skilled in the art that if a larger number of array elements 40 were used, this illumination function could be flattened further.

The voltage excitation for the patch elements 40 was permitted to be complex during optimization, but the optimization yielded real excitation values. It is believed that this resulted from the array face being coincident with the paraboloid focal plane as shown in FIG. 2.

The predicted H-plane pattern for the feed 20 was substantially similar to that of the E-plane. In addition, measured E and H-plane patterns for the feed 20 corresponded closely with the predicted values.

Figure 4B:
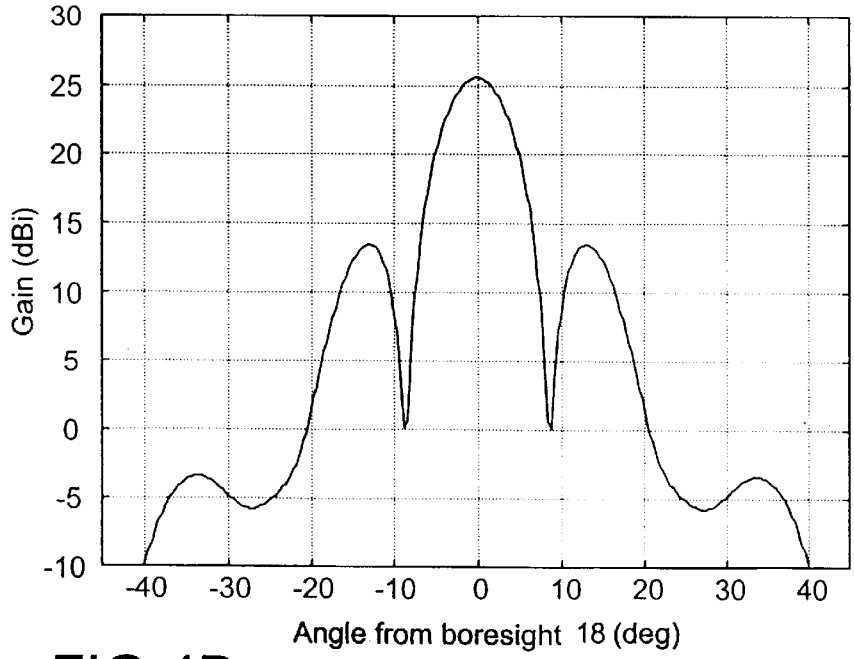
FIG. 4B is an estimated E-plane pattern for an antenna incorporating the feed array of FIG. 3.

FIG. 4B shows the predicted sum channel E-plane pattern of the 2.7" diameter reflector antenna 10 when fed with the optimized array feed 20 of FIG. 3. Note that the peak gain is 25.5 dBi which corresponds to a 56% efficiency relative to the area of the 2.7" diameter main reflector 12. Again, the measured E and H-plane patterns for the antenna 10 closely followed the predicted results.

Comparative Example

Figure 5:
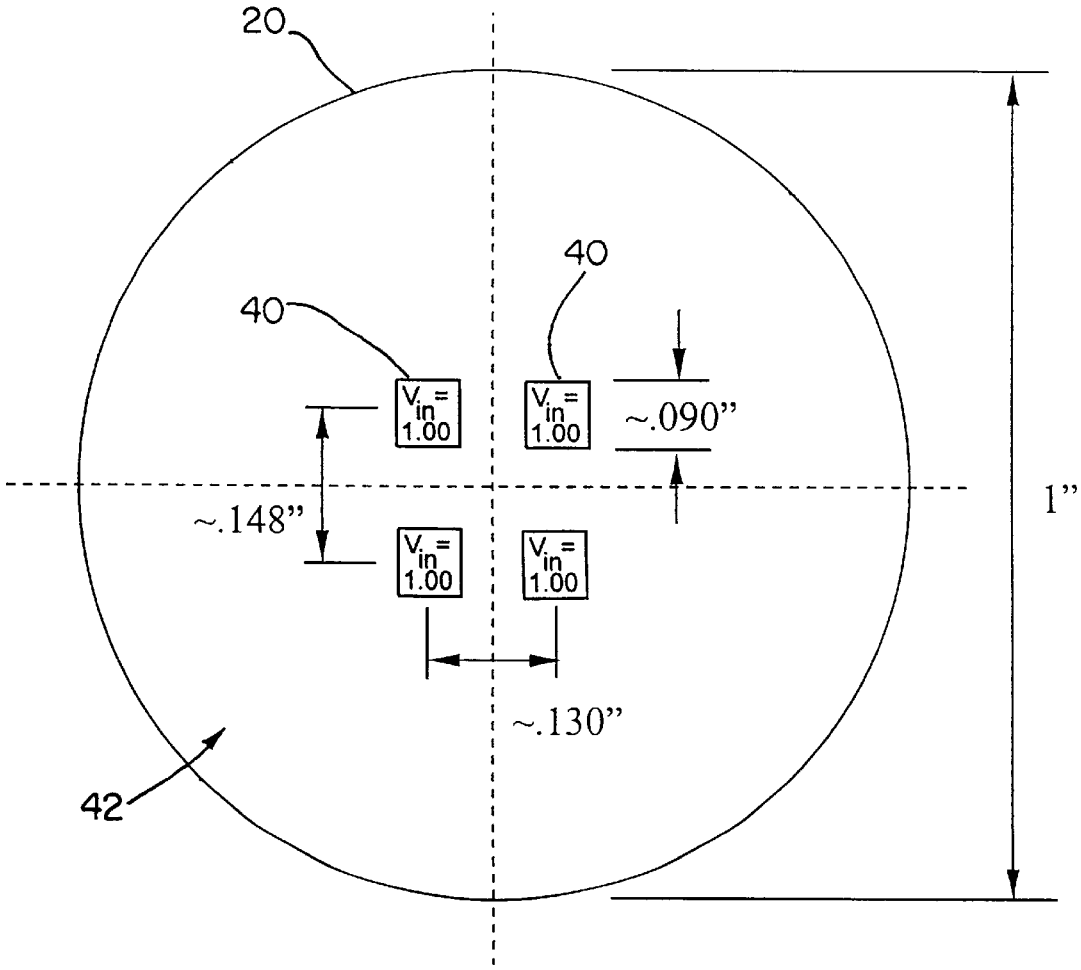
FIG. 5 is a front view of a feed array in accordance with a comparative example.
Figure 6A:
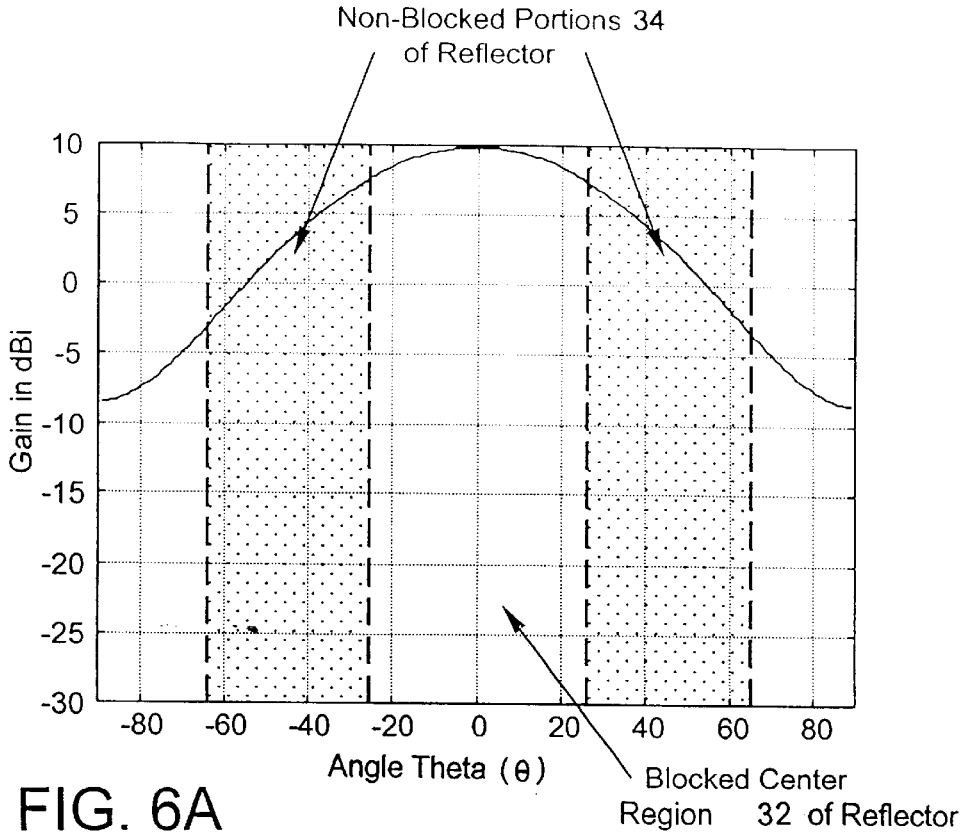
FIG. 6A is an estimated E-plane pattern for the feed array of FIG. 5.
Figure 6B:
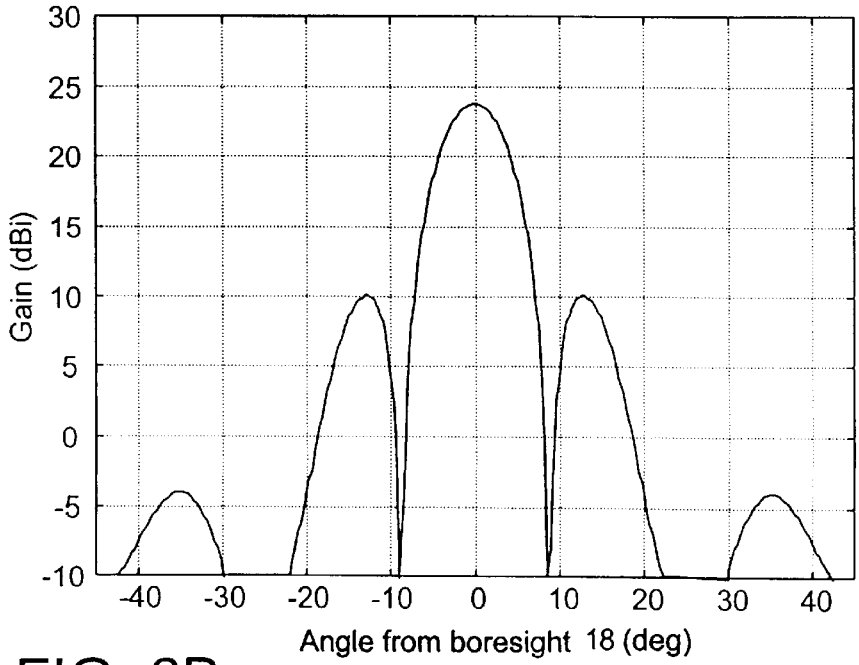
FIG. 6B is an estimated E-plane pattern for an antenna incorporating the feed array of FIG. 5.

In contrast to the predicted performance of the above proposed invention, one might consider the performance of a conventional monopulse feeding system. FIG. 5 shows a 4-patch array having four elements 40 which has been used in the past to feed a reflector antenna. This array has been optimized for maximum gain when feeding the 2.7" diameter common aperture reflector 12 as described above. Each patch element 40 is fed with voltages of equal amplitude and phase. The sum E-plane pattern of this array is shown in FIG. 6A. It will be noted from FIG. 6A that a good portion of the feed energy is wasted on the blocked central region 32 of the reflector antenna. This blockage has a detrimental effect on the gain and pattern of the reflector antenna as is shown in FIG. 6B. From this pattern the predicted peak gain of the reflector antenna is seen to be 23.8 dBi which corresponds to only a 41% efficiency relative to the total area of the main reflector 12. From these results it can be seen that the use of this invention increases the efficiency of the reflector antenna by about 20%.

According to a preferred method of the present invention, the RF feed 20 is designed and optimized according to the following technique. In the exemplary embodiment, the design and optimization of the feed array 38 making up the RF feed 20 is accomplished using a physical optics analysis computer program or code, taking into account the effect of the blocked region 32 of the main reflector 12. Such physical optics analysis is discussed in detail in W. V. T Rusch,. and P. D. Potter, *Analysis of Reflector Antennas,* Academic Press, New York, 1970, the entire disclosure of which is incorporated herein by reference.

Initially, the antenna 10 is modeled as shown in FIG. 2. The main reflector 12 of diameter D and focal length F is blocked by a structure of diameter b. As previously noted, such diameter b may be as a result of the RF feed 20, IR sub-reflector 22 and/or third sensor 26, whichever is largest. For the purposes of the optimization in the exemplary embodiment, it is assumed that the energy impinging on the blockage 30 (from the main reflector 12) is absorbed. The array feed 20 is assumed to be mounted on the underside of the blockage 30 at a distance F from the main reflector vertex 16.

A particular feed design is selected. For this particular exemplary design described herein, microstrip patch elements 40 are used as the elements of the feed array. However, it will be appreciated that other feed elements may be used to form the array. For example, the RF feed 20 may be made up of an array of feed horns, a slotted array, a lens array, etc. The present invention includes any such types of arrays without departing from the scope of the invention.

The optimization process is initiated by selecting a starting guess for the RF feed array configuration (e.g., number of array elements, element spacing and/or element amplitude excitation), with a predefined main reflector diameter D, focal length F, and blockage diameter b. A figure of merit is then computed (using the aforementioned physical optics code) that is minimized when the reflector antenna efficiency is maximum. A simplex optimization routine is then used which optimizes the array element spacing and excitation by minimizing the figure of merit. (See, e.g., G. Dahlquist, *Numerical Methods,* Prentice-Hall, New Jersey, 1974, the disclosure of which is incorporated herein by reference). Note that the amplitude excitation of the array elements in this optimization are complex-the magnitude and phase of each element is optimized.

Other methods may be used without departing from the scope of the invention.

It will therefore be appreciated that the present invention provides a common aperture antenna and method of making the same which maximizes antenna efficiency. The invention utilizes a specially configured antenna array as the prime-focus feed. By carefully configuring the array elements (spacing and excitation), the array illuminates only the non-blocked portion of the main reflector. In addition, the array pattern is optimized such that the non-blocked portion of the reflector antenna is quasi-uniformly illuminated.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A common aperture reflector antenna, comprising:

a main reflector having a generally parabolic reflective surface and a boresight axis extending from a vertex of the main reflector through a focal point of the main reflector;

a feed located generally at the focal point for illuminating the main reflector with and/or receiving from the main reflector radio frequency (RF) energy of a predefined RF wavelength to transmit/receive RF energy; and at least one of a sub-reflector and a sensor located generally at the focal point for reflecting or receiving energy of a predefined wavelength different from the predefined RF wavelength, wherein a blockage of the main reflector due to the sub-reflector or the sensor along the boresight axis is equal or greater than a blockage of the main reflector due to the feed, and the feed is configured to direct a majority of RF energy from the feed towards regions of the main reflector which are not blocked by the sub-reflector or the sensor.

2. The antenna of claim 1, wherein an E-plane radiation pattern of the feed exhibits peaks in the regions of the main reflector which are not blocked by the sub-reflector or the sensor.

3. The antenna of claim 2, wherein the peaks in the regions not blocked by the sub-reflector or the sensor exceed any peaks in a region blocked by the sub-reflector or the sensor.

4. The antenna of claim 1, wherein the feed comprises an array of individual feed elements.

5. The antenna of claim 4, wherein the feed elements comprise elements which are fed out of phase with other elements included among the feed elements.

6. The antenna of claim 4, wherein the feed comprises a microstrip patch array having a plurality of individual patch elements.

7. The antenna of claim 6, wherein the microstrip patch array comprises at least sixteen individual patch elements.

8. The antenna of claim 4, wherein the individual feed elements are arranged in a geometric array.

9. The antenna of claim 8, wherein the geometric array is generally square.

10. The antenna of claim 8, wherein individual feed elements along an outer perimeter of the geometric array are fed opposite in phase relative to individual feed elements within the perimeter of the geometric array.

11. The antenna of claim 1, wherein the predefined RF wavelength is in the microwave or millimeter wave bands, and the antenna comprises the sub-reflector at the focal point for reflecting energy in the infrared band.

12. The antenna of claim 11, wherein the antenna further comprises the sensor at the focal point for receiving energy at another predefined wavelength.

13. The antenna of claim 1, wherein the main reflector has a diameter D and the blockage of the main reflector due to the sub-reflector or the sensor has a diameter on the order of 3D/8 or more.

14. The antenna of claim 13, wherein the antenna has a focal length of approximately 3D/8.

15. The antenna of claim 13, wherein D is within a range of two inches to three inches.

16. The antenna of claim 13, wherein the feed comprises a microstrip patch array having a plurality of individual patch elements.

17. A method for designing a common aperture reflector antenna which includes a main reflector having a generally parabolic reflective surface and a boresight axis extending from a vertex of the main reflector through a focal point of the main reflector, a feed located generally at the focal point for illuminating the main reflector with and/or receiving from the main reflector radio frequency (RF) energy of a predefined RF wavelength to transmit/receive RF energy, and at least one of a sub-reflector and a sensor located generally at the focal point for reflecting or receiving energy of a predefined wavelength different from the predefined RF wavelength, wherein a blockage of the main reflector due to the sub-reflector or the sensor along the boresight axis is equal or greater than a blockage of the main reflector due to the feed, the method comprising the steps of:

selecting an initial estimate for a feed array making up the feed on a basis of blockage of the main reflector due to the sub-reflector or the sensor and at least one of a number of array elements, spacing of the array elements, amplitude excitation of the array elements, diameter of the main reflector and focal length of the main reflector;

evaluating a performance of the feed array based on the initial estimate;

computing a figure of merit indicative of the RF efficiency of the antenna based on the evaluated performance; and optimizing the RF efficiency by altering the initial estimate and reevaluating the performance and figure of merit.

18. The method of claim 17, wherein the step of evaluating the performance of the feed array is based on an estimation that the blockage of the main reflector due to the sub-reflector or the sensor results in otherwise incident energy being absorbed.

19. The method of claim 17, wherein the optimizing step comprises altering an excitation amplitude and phase of the array elements.

20. The method of claim 17, wherein the steps of evaluating, computing and optimizing are carried out via a computer.

* * * * *